US005213120A

United States Patent [19]

Dickson

[11] Patent Number: 5,213,120

[45] Date of Patent: May 25, 1993

[54] METHOD AND APPARATUS FOR GENERATING FOAM WITHIN A PIPE

[76] Inventor: Michael A. Dickson, P.O. Box 452, Wichita, Kans. 67201

[21] Appl. No.: 873,098

[22] Filed: Apr. 24, 1992

[51] Int. Cl.[5] ..... B08B 9/02

[52] U.S. Cl. ..... 134/102.1; 134/167 C; 134/168 C; 134/169 C; 261/DIG. 26

[58] Field of Search ..... 134/102.1, 167 C, 168 C, 134/169 C; 261/DIG. 26

[56] References Cited

U.S. PATENT DOCUMENTS

| | | | |
|---|---|---|---|
| 3,419,082 | 12/1968 | O'Regan et al. | 261/DIG. 26 |
| 3,874,926 | 4/1975 | Horne et al. | 134/167 C X |
| 4,103,876 | 8/1978 | Hasselman, Jr. et al. | 261/DIG. 26 |
| 4,730,676 | 3/1988 | Luers et al. | 261/DIG. 26 |
| 4,981,524 | 1/1991 | Waite | 134/167 C X |

FOREIGN PATENT DOCUMENTS

| | | | |
|---|---|---|---|
| 885406 | 12/1961 | United Kingdom | 261/DIG. 26 |

*Primary Examiner*—Frankie L. Stinson

[57] ABSTRACT

A foam generator is provided for generating a treatment foam within a pipe, such as a sewer pipe, in need of treatment. The foam generator includes a foam generating head having a first perforated conduit for carrying a fluid such as compressed air and a second perforated conduit surrounding said first conduit for carrying a fluid such as a liquid which contains a foaming agent and a treatment chemical. A wicking material surrounds the first and second conduits in the foam generating head and receives the compressed air and liquid from the conduits and causes the production of a foam. A pressure casing can surround the foam generating head for delivering the foam under increased pressure to coat an inner wall surface of the pipe.

11 Claims, 3 Drawing Sheets

METHOD AND APPARATUS FOR GENERATING FOAM WITHIN A PIPE

BACKGROUND OF THE INVENTION

The present invention relates in general to the chemical treatment of sewer and other types of pipes, and, more particularly, to a method and apparatus for generating a chemical foam for filling or coating the interior of such pipes.

Various types of chemicals are used in sewer and other types of pipes to kill tree roots and other types of organic matter which can cause blockage of the pipe if their growth is not periodically controlled. Chemical treatments of this type are most effective if the chemical remains in contact with the roots for a period of time. In general, extended contact of the chemical with the organic matter can be achieved by placing a plug in the pipe and then filling the downline portion of the pipe with the chemical in liquid form or as a foam: While this type of treatment can be effective for smaller diameter pipes, it is typically uneconomical to use this technique on larger diameter pipes because of the large volume of chemical or foam needed to fill the pipe. Thus, on larger diameter pipes it is desirable to coat the inner wall of the pipe with a chemical foam which will cling to the inner wall for the desired time period.

Various methods are available to generate the foam which contains the chemical used to kill the organic matter in pipes. Typically, the chemical is mixed with a foaming agent and is then pumped into the pipe being treated through a flexible conduit which has an application head or spray nozzle connected at its end. Examples of application systems of this type are disclosed in U.S. Pat. No. 4,944,320 to Waite et al. and U.S. Pat. No. 3,880,176 to Horne. One problem with systems of this type is the difficulty in controlling the consistency of the foam at the outlet nozzle. Because the foam is pumped into the pipe through the conduit which may be several hundred feet in length, by the time the foam arrives at the outlet nozzle, it often has a far different consistency than when it was initially produced. In some instances, the foam discharged by the nozzle has considerably less entrained air than when it was initially formed. A larger amount of foam and chemical is then required to completely fill the pipe or coat the inner wall surface. In addition to the added expense resulting from producing this additional foam, the foam itself may have a liquid consistency which results in its collapse before it has remained in contact with the organic matter for the desired length of time. Less than completely effective treatment may thus result from the pumping of such foam into the pipe being treated.

A need has thus developed for a system which can be used to produce and apply a chemical foam having a desired consistency at a remote location within a length of pipe.

SUMMARY OF THE INVENTION

It is an object of this invention to provide an apparatus which can be used to produce foam containing a chemical for treating the interior of a pipe, which foam has a high volume of entrained air so that a reduced amount of treatment chemical is required to fill the pipe interior and so that the chemical will remain in contact with the pipe for an extended period of time.

It is also an object of this invention to provide an apparatus for generating a treatment foam within a pipe in need of treatment so that the foam does not have to be pump through a long conduit to reach the pipe, thereby providing greater control over the consistency of the foam produced.

It is another object of this invention to provide an apparatus for generating and applying a treatment foam within a pipe, which apparatus is constructed from readily available and inexpensive components so that the apparatus can be economically produced.

It is a further object of this invention to provide an apparatus for generating a treatment foam within a pipe and applying the foam with sufficient force to cause coating of the inner wall surfaces of the pipe without requiring that the foam fill the inner volume of the pipe, thereby greatly reducing the amount of foam required to treat pipes, particularly large diameter pipes such as sewer main pipes.

To accomplish these and other related objects of the invention, in one aspect the invention is related to an apparatus for generating foam within a pipe for application to an inner wall surface of the pipe, which foam is capable of containing a chemical for treatment of the inner wall surface of the pipe, said apparatus comprising:

a container having an outer wall defining an interior cavity, said outer wall containing a plurality of openings therethrough;

a first conduit extending within said interior cavity of the container and having a wall in which a plurality of apertures are formed, said first conduit being constructed in a manner for connection with a supply of compressed first fluid, whereby said first fluid can be supplied to said first conduit for delivery through said apertures;

a second conduit in association with said first conduit within said interior cavity of the container and having a wall in which a plurality of apertures are formed, said second conduit being constructed in a manner for connection with a supply of a second fluid, whereby said second fluid can be supplied to said second conduit for delivery through said apertures of the second conduit for mixing with the fluid delivered through said apertures of the first conduit; and a wicking material surrounding said first and second conduits within said cavity for receiving said delivered first and second fluids to cause mixing thereof and formation of said foam for delivery through the openings in the outer wall of said casing to the inner wall surfaces of said pipe.

In another aspect, the invention is related to a pressure casing which may surround said container and has a plurality of dispersal openings formed in a wall portion thereof, said dispersal openings being sized to cause a pressure buildup within said pressure casing when said first and second conduits are being supplied with said first and second fluids, whereby said foam delivered through said openings in the outer wall of the container is delivered under increased pressure through said dispersal openings to coat said inner wall surface of the pipe.

BRIEF DESCRIPTION OF THE DRAWINGS

In the accompanying drawings which form a part of the specification and are to be read in conjunction therewith and in which like reference numerals are used to indicate like parts in the various views.

DESCRIPTION OF THE PREFERRED EMBODIMENT

Figure 1:
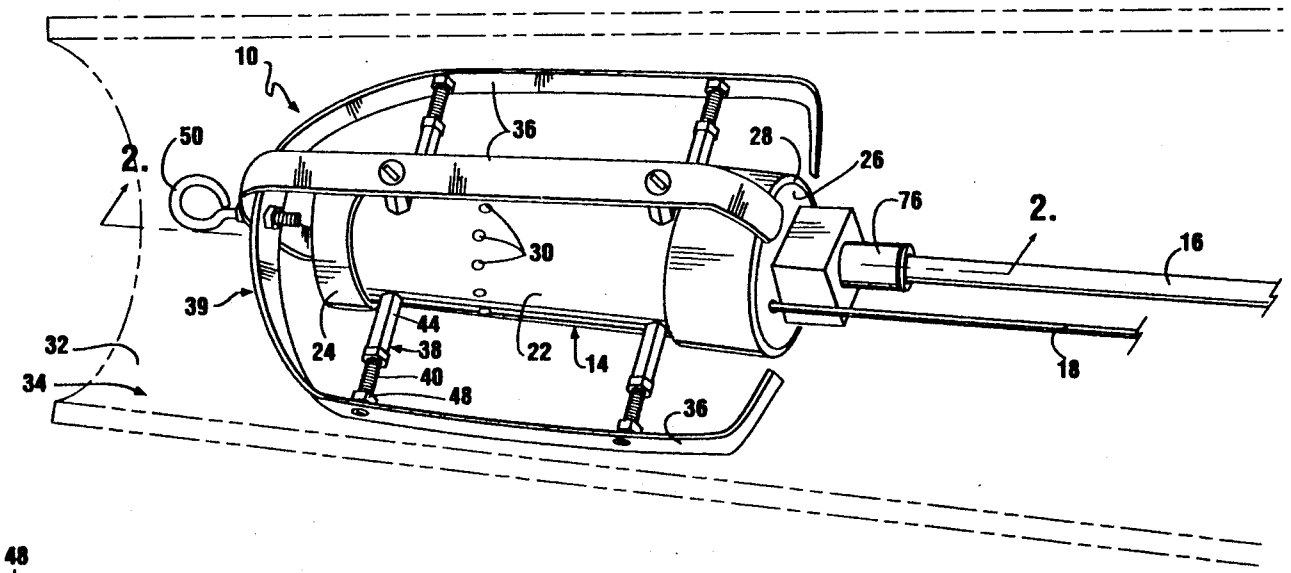
FIG. 1 is a side perspective view of a foam generator in accordance with the present invention and shown within a pipe which is shown in phantom lines, portions of the conduits used to supply a chemical and foaming agent to the foam generator also being shown in fragment
Figure 2:
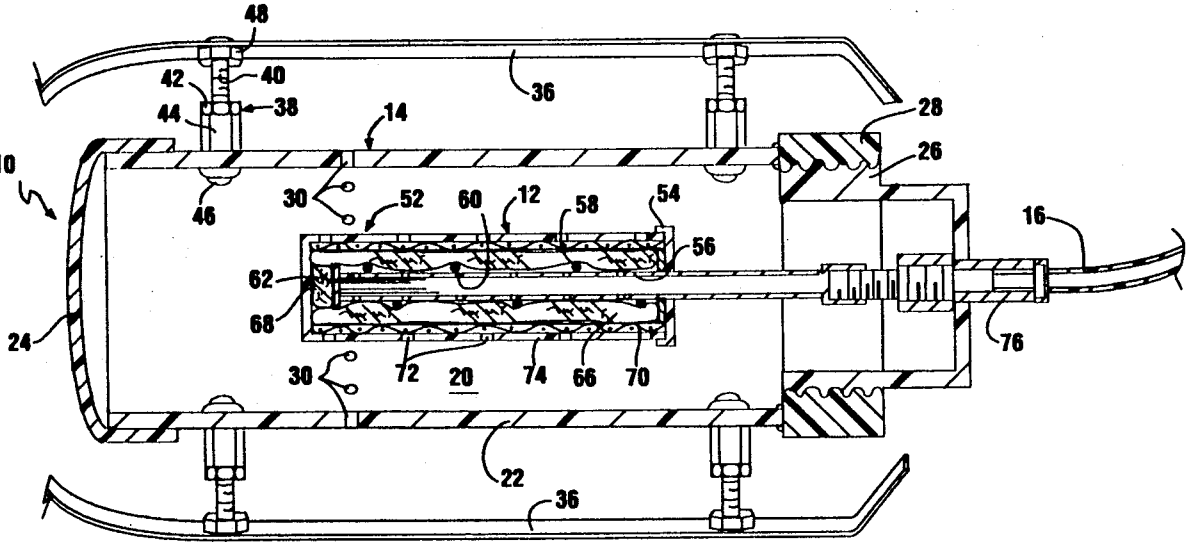
FIG. 2 is a fragmentary side elevational view of the foam generator taken in cross section along line 2—2 of FIG. 1.

Referring now to the drawings in greater detail and initially to FIGS. 1-5, a first embodiment of a foam generator in accordance with the present invention is represented generally by the numeral 10. Foam generator 10 comprises a foam generating head 12 which is positioned within an external pressure casing 14. A first fluid, preferably compressed air, is supplied from a supply tank 15 to foam generating head 12 through conduit 16. A second conduit 18 carries a second fluid, preferably one containing a foaming agent and a treatment chemical, from a supply tank 19*a* to the foam generating head 12. A compressor 19*b* or other suitable means may be used to supply the pressure required to deliver the first and second fluids to the foam generating head 12. It will be appreciated that tanks 15 and 19*a* may be combined in a manifold or other suitable arrangements may be utilized for delivering the fluids to foam generating head 12.

Foam generated by head 12 fills an internal chamber 20 defined by a cylindrical wall 22 of casing 14. The chamber 20 is closed at one end by a cap 24 which is suitably secured to cylindrical wall 22. The other end of chamber 20 is closed by an externally-threaded plug 26 which engages internal threads of a fitting 28 provided at that end of the casing 14. A plurality of dispersal holes 30 are provided in the cylindrical wall 22 of casing 14 and lie in a plane which is generally perpendicular to the longitudinal length of casing 14.

Foam is dispersed through dispersal holes 30 in pressure casing 14 to coat an inner wall surface 32 of an elongated conduit 34 such as a sewer pipe. The conduit 34 may extend in a generally horizontal orientation as illustrated but it may also be in a vertical orientation or inclined at angles between the horizontal and vertical. The foam delivered through dispersal holes 30 in casing 14 may also be supplied in a quantity sufficient to fill the pipe 34 in addition to coating the inner wall surface 32.

A plurality of bands 36 extend along the length of casing 14 and are spaced outwardly therefrom by adjustable spacers 38 which are mounted to the cylindrical wall 22 of casing 14. The bands 36 and spacers 38 cooperate to form a skid 39 which allows the casing 14 to be spaced from the inner wall surface 32 of pipe 34. Each spacer 38 includes a bolt 40 which extends through the band 36 and is threadably received by a nut 42 which is mounted on an extender 44. The extender 44 is in turn mounted to the casing cylindrical wall 22 by a bolt 46 which extends outwardly from within chamber 20. The positioning of the bands 36 in relation to the casing cylindrical wall 22 can be varied by simply turning the slotted head of bolts 40 with a screwdriver. Turning of the bolts 40 in one direction causes the associated bands 36 to be brought closer to the casing 40 while rotation of the bolt in the other direction causes the bands to be moved radially outward from casing 14. This adjustability of bands 36 allows a range of diameters for the skid to be obtained. A backup nut 48 is provided on each bolt 40 and is positioned to engage one side of band 36 while the bolt 40 head engages the other side of the band.

Figure 3:
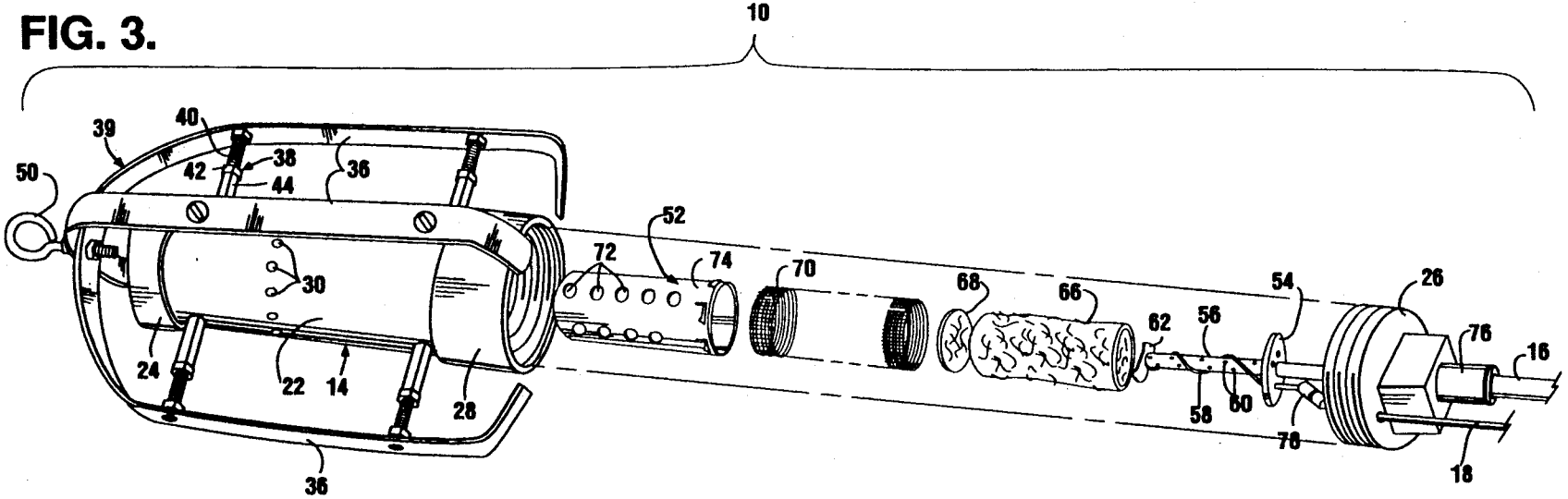
FIG. 3 is an exploded side perspective view of the foam generator shown in FIG. 1, portions of the conduits used to supply the chemical and foaming agent to the foam generator being shown in fragment.
Figure 5:
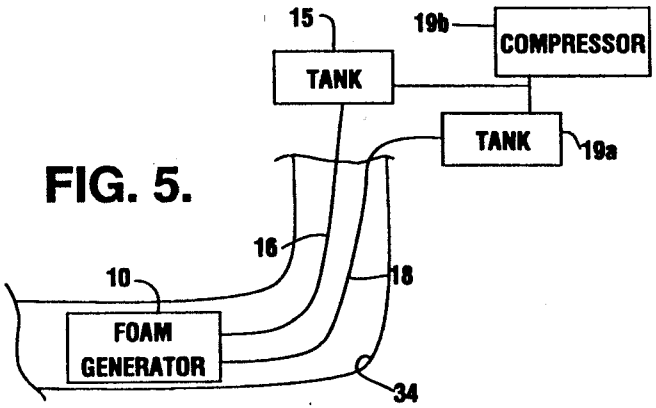
FIG. 5 is a diagrammatic view of a system incorporating the foam generator in accordance with the present invention.
Figure 4:
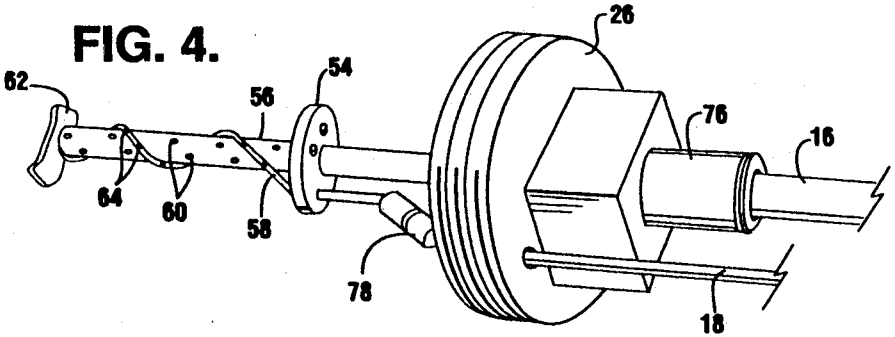
FIG. 4 is an enlarged side perspective view of a portion of the foam generator shown in FIG. 3.

As can best be seen in FIGS. 1 and 3, a single length of band material extends along one side of casing 14 and is bent back so that it extends along the opposite side of casing 14. A single piece of band material thus forms two legs of the skid. A suitable ex-bolt 50 is secured to the overlapping bands 36 at a position forward of the end cap 24 on casing 14. The ex-bolt 50 extends forwardly and generally coaxially with the longitudinal axis of casing 14 for connecting with a suitable pull line for pulling the foam generator 10 through the pipe or conduit 34. Advantageously, the bands 36 may be formed from inexpensive materials such as strap metal.

The foam generating head 12 in accordance with the present invention comprises a cylindrical container 52 which is closed at one end by a removable cap 54. While the container 52 can be formed from various types of material, it has been found that ordinary pill bottles or film containers provide a readily available and inexpensive source for containers 52. Extending within the container 52 through cap 54 are a first fluid dispersal tube 56 and a second fluid dispersal tube 58. As can best be seen in FIG. 4, the first fluid dispersal tube 56 contains a plurality of perforations 60 which are spaced along its length. The end of tube 56 also includes a positioning member 62 which seats against an inner surface of the closed end of container 52 and maintains the tube 56 in an axially central position within container 52. The second fluid dispersal tube 58 is of greatly reduced diameter in comparison to tube 56 and is wrapped around tube 56 in a helical fashion. The second fluid dispersal tube 58 likewise contains a plurality of perforations 64.

The foam generating head 12 also includes a layer of wicking material 66 which surrounds the first and second fluid dispersal tubes 56 and 58 within container 52. A plug 68 of the same wicking material may be provided to close off the end of the cylindrical layer 66 of wicking material. The wicking material is selected from various types of porous material which will allow of mixing of the fluids being dispersed through dispersal tubes 56 and 58 and the production of foam as a result of such mixing. It has been found that various types of sintered materials, such as powdered metal that is heated and pressed together, are especially preferred as the wicking material because their internal structure greatly facilitates the production of bubbles which form the foam. Another preferred type of material is that sold under the trademark ScotchBrite. In general, if larger particulate matter is to be carried by the foam, then a loose weave wicking material such as screen is required.

A protective screen 70 surrounds the layer of wicking material layer 66 within the container 52. The screen 70 preferably has a mesh size which does not interfere with the flow of foam from the wicking material 66 and at the same time serves to prevent the entry of debris into the wicking material 66.

Foam generated within head 12 flows outwardly from within container 52 through a plurality of apertures 72 provided in container wall 74. The foam then flows into the surrounding chamber 20 defined by the outer casing 14 and then is forced through the dispersal holes 30 in casing wall 22 to coat the inner wall surface 32 of pipe 34.

In order to facilitate connection of the first and second fluid dispersal tubes 56 and 58 with conduits 16 and 18, respectively, it is desirable to provide quick-connect fittings. One such fitting 76 is threaded onto an end of the first fluid dispersal tube 56 which extends through plug 26. A similar fitting 78 is provided within casing 14 to connect conduit 18 with the second fluid dispersal tube 58. If desired, other types of fittings may be used in place of the quick-connect fittings 76 and 78.

In operation, the foam generator 10 may be used to chemically treat the inner wall surface 32 of pipe 34. For example, foam generator 10 may be used in the application of a chemical to kill tree roots and other organic matter in sewer pipes. It is to be understood that this is only one of various types of applications for which foam generator 10 is suited. Foam is generated within foam generating head 12 by supplying a fluid, preferably compressed air, through conduit 16 to the first fluid dispersal tube 56 located within head 12. A second fluid, preferably one containing a foam generating substance and the active chemical, is supplied to second fluid dispersal tube 58 through conduit 18. The first and second liquids are dispersed through the perforations 60 and 64 provided in tubes 56 and 58 respectively. The fluids then enter the wicking material 66 where they intermix and form small bubbles which collectively comprise the foam. The foam is then carried through the aperture 72 provided in container 52 and flows into the casing chamber 20. That portion of the first fluid which was not utilized in formation of the foam then carries the foam through dispersal holes 30 in the cylindrical casing wall 22. It will be appreciated that the force with which the foam is dispersed through holes 30 will depend upon the total area of those holes in relation to the volumetric flow of the first fluid. Desirably, the relationship between these parameters is such that the foam is carried through the dispersal holes 30 with a sufficient velocity to cause splattering against the inner wall surface 32 of pipe 34. This allows the entire inner wall surface 32 to be coated with the foam carrying the active chemical without having to fill the entire volume of pipe 34. In other applications, however, it may be desirable to completely fill the pipe 34 and the foam generator 10 can be operated in a manner to accomplish this.

It will be appreciated that the chamber 20 allows for the accumulation of the foam produced by foam generating head 12 prior to its expulsion through dispersal holes 30. In addition, chamber 20 provides sufficient room for the foam to expand. This contributes to a less liquid and more airy-type foam which will maintain its structural integrity for a longer period of time. Moreover, expansion of the foam within chamber allows a given quantity of foam to coat a greater area of pipe because it has a larger volume than it otherwise might if it were unable to adequately expand from its more liquid state prior to application to the pipe 34.

Advantageously, the production of foam by the mixing of the first and second fluids within the foam generating head 12 allows for much greater control over the consistency of the foam produced and its application within the pipe being treated. In contrast to conventional systems in which the foam is mixed through a control panel and is then conveyed through a long conduit into the pipe in need of treatment, the foam generator 10 of the present invention allows for the production of foam directly at that portion of the pipe which is being treated. The foam can thus have a significantly greater volume per amount of foaming agent than could be achieved by creating the foam as it is being pumped through a conduit which may be several hundred feet in length for dispersal through a spray nozzle. In addition to significant savings in the amount of foaming agent, savings in the amount of the active chemical can also be achieved because the foam will maintain its integrity for an extended period of time. The chemical is thus held in contact with the inner wall surface 32 of the pipe 34 for an extended period of time. This allows for more effective chemical treatment of the pipe 34 and significantly lower costs than can otherwise be achieved.

Figure 6:
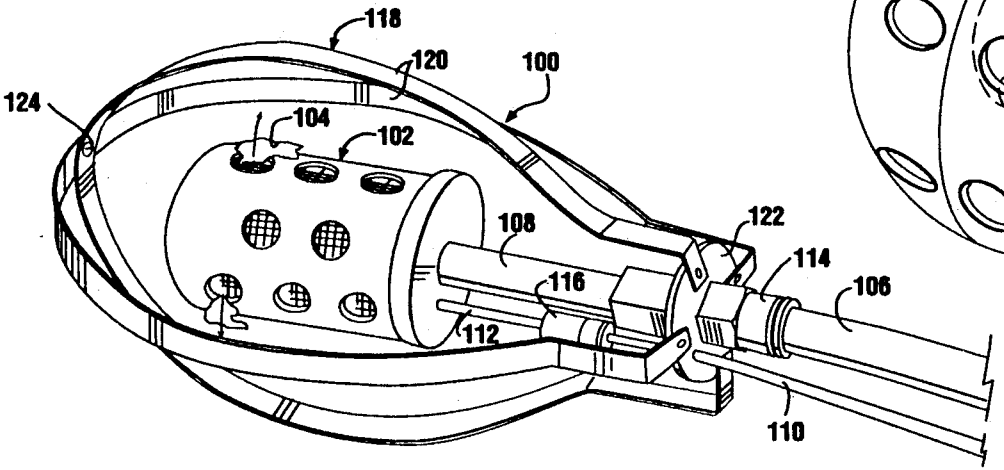
FIG. 6 is a fragmentary side perspective view of another embodiment of a foam generator in accordance with the present invention.

Turning now to FIG. 6, an alternate embodiment of a foam generator in accordance with the present invention is represented broadly by the numeral 100. Foam generator 100 includes a foam generating head 102 which is somewhat shorter than but otherwise generally identical to the foam generating head 12 previously described. A foam 104 is generated within head 102 in the manner previously described by supplying a first fluid through a conduit 106 and a first dispersal tube 108. A second fluid is supplied to the foam generating head 102 through a second conduit 110 and a second fluid dispersal tube 112. Quick connect fittings 114 and 116 are used to connect the conduits 106 and 110 with their respective dispersal tubes 108 and 112.

Foam generator 100 includes a skid 118 which is used to elevate the foam generating head 102 within the pipe being treated. The skid 118 comprises a plurality of rigid but resilient bands 120 which extend forwardly from an anchor plate 122 along one side of head 102 and then are doubled back along the other side of head 102 and anchored to plate 122. A rivet 124 is used to secure the overlapping bands 120 together at the forward end of foam generator 100.

Foam generator 100 is suitable for producing foam 104 which is used to chemically treat the interior of a pipe in much the same fashion as described with respect to foam generator 10. Unlike foam generator 10, the foam generator 100 shown in FIG. 5 does not include an outer .casing which is used to increase the delivery velocity of the foam. Foam generator 100 is thus particularly adapted for use in smaller diameter pipes where filling of the pipe with foam is desired.

Figure 7:
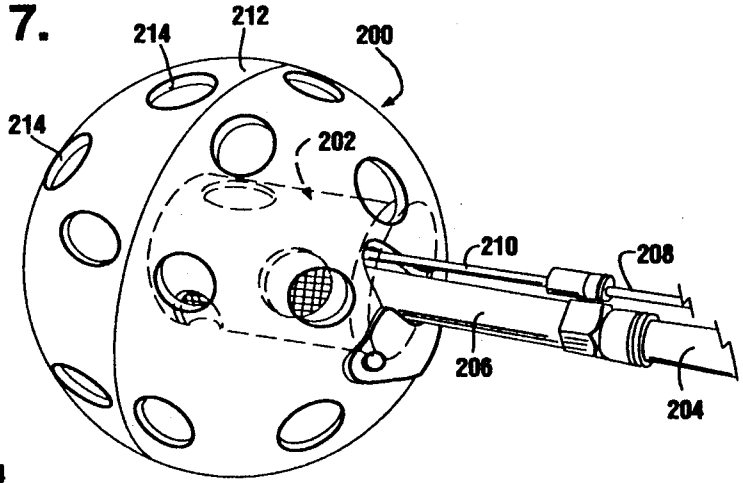
FIG. 7 is a side perspective view of a still further embodiment of a foam generator in accordance with the present invention.
Figure 8:
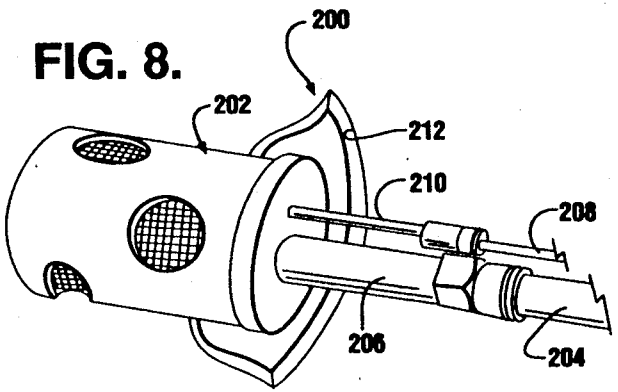
FIG. 8 is a fragmentary side perspective view of the foam generator shown in FIG. 7 but with portions of the outer skid being removed to show details of the foam generating head.

A still further embodiment of a foam generator in accordance with the present invention is shown in FIGS. 7–8 and is represented generally by the numeral 200. Foam generator 200 includes a foam generating head 202 of the general type previously described which is supplied with a first fluid through a first conduit 204 and a first dispersal tube 206. A second fluid is supplied to the head 202 through a second conduit 208 and a second dispersal tube 210.

Foam generator 200 includes an outer casing 212 which encloses the foam generating head 202. The casing 212 is generally spherical in configuration and includes a plurality of dispersal holes 214 through which the foam generated by head 202 passes through casing 212 to coat the inner surface of a pipe. The foam generator 200 may be operated in a manner which is substantially the same as that described with respect to the previous embodiments.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. An apparatus for generating foam within a pipe for application to an inner wall surface of the pipe, which foam is capable of containing a chemical for treatment of the inner wall surface of the pipe, said apparatus comprising:

a container having an outer wall defining an interior cavity, said outer wall containing a plurality of openings therethrough;

a first conduit extending within said interior cavity of the container and having a wall in which a plurality of apertures are formed, said first conduit being constructed in a manner for connection with a supply of compressed first fluid, whereby said first fluid can be supplied to said first conduit for delivery through said apertures;

a second conduit in association with said first conduit within said interior cavity of the container and having a wall in which a plurality of apertures are formed, said second conduit being constructed in a manner for connection with a supply of a second fluid, whereby said second fluid can be supplied to said second conduit for delivery through said apertures of the second conduit for mixing with the fluid delivered through said apertures of the first conduit; and a wicking material surrounding said first and second conduits within said cavity for receiving said delivered first and second fluids to cause mixing thereof and formation of said foam for delivery through the openings in the outer wall of said casing to the inner wall surfaces of said pipe.

2. The apparatus as set forth in claim 1, including a pressure casing surrounding said container and having a plurality of dispersal openings formed in a wall portion thereof, said dispersal openings being sized to cause a pressure buildup within said pressure casing when said first and second conduits are being supplied with said first and second fluids, whereby said foam delivered through said openings in the outer wall of the container is delivered under increased pressure through said dispersal openings to coat said inner wall surface of the pipe.

3. The apparatus as set forth in claim 2, including a skid surrounding said pressure casing for spacing said pressure casing from the inner wall surface of the pipe when positioned therewithin.

4. The apparatus as set forth in claim 1, including a skid surrounding said container for spacing said container from the inner wall surface of the pipe when positioned therewithin.

5. The apparatus as set forth in claim 1, including a perforate screen surrounding said wicking material within the container.

6. The apparatus as set forth in claim 1, wherein said wicking material comprises a sintered material.

7. An apparatus for generating foam within a pipe for application to an inner wall surface of the pipe, which foam is capable of containing a chemical for treatment of the inner wall surface of the pipe, said apparatus comprising:

a container having an outer wall defining an interior cavity, said outer wall containing a plurality of openings therethrough;

a first conduit extending within said interior cavity of the container and having a wall in which a plurality of apertures are formed, said first conduit being constructed in a manner for connection with a supply of compressed first fluid, whereby said first fluid can be supplied to said first conduit for delivery through said apertures;

a second conduit in association with said first conduit within said interior cavity of the container and having a wall in which a plurality of apertures are formed, said second conduit being constructed in a manner for connection with a supply of a second fluid, whereby said second fluid can be supplied to said second conduit for delivery through said apertures of the second conduit for mixing with the fluid delivered through said apertures of the first conduit;

a wicking material surrounding said first and second conduits within said cavity for receiving said delivered first and second fluids to cause mixing thereof and formation of said foam for delivery through the openings in the outer wall of said casing to the inner wall surfaces of said pipe; and a pressure casing surrounding said container and having a plurality of dispersal openings formed in a wall portion thereof, said dispersal openings being sized to cause a pressure buildup within said pressure casing when said first and second conduits are being supplied with said first and second fluids, whereby said foam delivered through said openings in the outer wall of the container is delivered under increased pressure through said dispersal openings to coat said inner wall surface of the pipe.

8. The apparatus as set forth in claim 7, including a skid surrounding said pressure casing for spacing said pressure casing from the inner wall surface of the pipe when positioned therewithin

9. The apparatus as set forth in claim 8, including a perforate screen surrounding said wicking material within the container.

10. The apparatus as set forth in claim 9, wherein said wicking material comprises a sintered material.

11. The apparatus as set forth in claim 8, wherein said skid is adjustable to vary the spacing of the pressure casing from the inner wall surface of the pipe.

* * * * *